United States Patent [19]

Wile et al.

[11] Patent Number: 4,820,450

[45] Date of Patent: Apr. 11, 1989

[54] COMPOSITION FOR PRECIPITATING DIRT AND OTHER CONTAMINANTS FROM WASH WATER AND METHOD OF CLEANING

[75] Inventors: Raymond G. Wile, Liberty, Mo.; Ismail F. Middien, Kansas City, Kans.

[73] Assignee: E and R Investments, Kansas City, Kans.

[21] Appl. No.: 48,797

[22] Filed: May 12, 1987

Related U.S. Application Data

[63] Continuation of Ser. No. 878,671, Jun. 26, 1986, abandoned.

[51] Int. Cl.[4] ..... C11D 1/94; C11D 3/30

[52] U.S. Cl. ..... 252/545; 134/34; 134/42; 210/723; 210/729; 210/734; 210/735; 252/173; 252/174.16; 252/174.23; 252/525; 252/526; 252/524; 252/528; 252/542; 252/544; 252/547; 252/180; 252/DIG. 5; 252/DIG. 7; 252/DIG. 17

[58] Field of Search ..... 252/173, 174.16, 174.23, 252/525, 526, 524, 528, 542, 544, 545, 547, DIG. 5, DIG. 7, 180, DIG. 17; 134/34, 42; 210/723, 729, 734, 735

[56] References Cited

U.S. PATENT DOCUMENTS

| | | | |
|---|---|---|---|
| 2,874,124 | 2/1959 | Vitalis | 252/DIG. 15 |
| 3,254,028 | 5/1966 | Wixon | 252/524 |
| 3,449,255 | 6/1969 | Johnston | 252/117 |
| 3,929,697 | 12/1975 | Morrill et al. | 106/214 |
| 4,014,808 | 3/1977 | Herpers, Jr. et al. | 252/174.18 |
| 4,096,084 | 6/1978 | Thomsen et al. | 252/174.23 |
| 4,420,399 | 12/1983 | Redmore | 252/180 |
| 4,490,536 | 12/1984 | Corti et al. | 548/112 |

*Primary Examiner*—Robert Wax

*Attorney, Agent, or Firm*—Kokjer, Kircher, Bradley, Wharton, Bowman & Johnson

[57] ABSTRACT

A method and cleaning composition are the subject of the invention. The cleaning composition may take the form of an aqueous solution, a powder, or a concentrated powder or aqueous solution for addition to a cleaning solution. The additive includes an amine or polyacrylamide flocculant and a betaine stabilizer. When used in a detergent solution, the flocculant causes contaminates introduced into the water to precipitate and quickly settle to the bottom of the cleaning bucket. This keeps the upper part of the detergent solution clean and prevents the mop from picking up and subsequently redepositing the contaminates each time it is dipped in the bucket.

31 Claims, No Drawings

COMPOSITION FOR PRECIPITATING DIRT AND OTHER CONTAMINANTS FROM WASH WATER AND METHOD OF CLEANING

This is a continuation of application Ser. No. 878,671, filed June 26, 1986, now abandoned.

BACKGROUND OF THE INVENTION

This invention relates generally to cleaning solutions and more particularly to an additive which is useful in aqueous solutions to quickly precipitate and settle dirt particles and other foreign matter introduced into the solution.

In general janitorial cleaning and in other cleaning operations, floors and other surfaces are mopped or wiped in order to remove dirt, and the mop or other cleaning tool is then dipped into the wash water to remove the dirt that is picked up by the mop head or other cleaning tool. The solution thus quickly becomes contaminated with the dirt that is introduced into it, and the mop picks up dirt from the cleaning solution and redeposits it on the surface from which it was previously removed.

There are a large number of other situations in which cleaning solutions can become contaminated by dirt and other foreign matter which is subsequently redeposited on the surface which is being cleaned. Typical examples of such situations include general household cleaning, the scrubbing of surfaces with a scrub brush, and the washing of vehicles with automatic equipment or by hand with a sponge or rag. Other examples of cleaning applications where solutions become quickly contaminated and lose their effectiveness include cleaning of metal and other objects by soaking and immersion, sometimes in a number of solutions contained in different vessels.

U.S. Pat. No. 4,014,808 discloses a detergent composition which includes a flocculant for effecting coagulation of soilage present on a soiled floor surface. It is necessary to apply the detergent in a thick layer, to violently agitate the layer, and to thereafter filter the solution in order to remove the flocs of contaminant particles. The need for forceful agitation virtually mandates the use of machinery, while the need for filtration further complicates the cleaning process and makes it impractical for general janitorial cleaning operations. The large floc size resulting from this prior art teaching also precludes disposal in a municipal sanitary sewer system.

U.S. Pat. No. 3,449,255 to Johnston discloses the use of a polyacrylamide polymer for reducing the friction of a mop used in cleaning a floor surface. There is no disclosure in this patent of employing a flocculant capable of precipitating dirt from the solution and no teaching of how such a flocculant can be stabilized for long periods of time so as to result in a practical shelf life.

The Herpers et al. U.S. Pat. No. 4,014,808 discloses a detergent composition employing a polyelectrolyte flocculant such as polyacrylamides so as to maintain dirt and other contaminants in solution in the form of a floc. These patentees did not contemplate the precipitation of contaminant particles from solution and offer no teaching of how this could be accomplished.

SUMMARY OF THE INVENTION

The present invention is directed to a novel aqueous cleaning solution additive, to a detergent which includes the additive, and to a cleaning method which makes use of the additive in combination with a detergent.

It is an important object of the invention to provide a cleaning solution additive which includes a flocculant having the capability of precipitating contaminants and causing the precipitated particles to settle in order to effectively remove them from the solution without the need for filtration or other special treatment. As a result of the ability of the flocculant to cause precipitation and settling of dirt particles, the upper part (approximately 95%) of the solution in a container remains clean so that contaminants introduced into the solution are not redeposited in appreciable amounts when a mop or other applicator is subsequently dipped in the solution.

Another important object of the invention is to provide a cleaning solution additive which includes a stabilizer that is effective to maintain the flocculant in solution over a prolonged time period so that the additive has an extended shelf life. The flocculant is preferably a polyamine resin which is especially effective in precipitating contaminants but which is by itself relatively unstable. However, the use of a betaine stabilizer in the additive makes the polyamine much more stable and gives the additive a shelf life that is long enough to make it a commercially practical product.

A further object of the invention is to provide a cleaning solution additive of the character described which is compatible with a wide range of detergents. Again, the polyamine flocculant is preferred, in part because of its compatibility with a wide variety of popular detergent formulations.

An additional object of the invention is to provide an additive that is well suited to be added to a detergent either at the point of use or at the time the detergent is packaged. Accordingly, the additive can be made a part of the detergent or it can be packaged separately and added to the detergent solution at the point of use.

Yet another object of the invention is to provide a wide variety of detergent formulations which each include the additive according to the present invention.

A still further object of the invention is to provide a method of preparing a cleaning solution and using same to clean floors and other surfaces more effectively and efficiently than is accomplished when existing cleaning solutions are used.

A very important objective of this invention is to provide a method of cleaning a surface utilizing a detergent composition according to the present invention.

Another one of the important objects of this invention is to provide a detergent, a detergent additive, a rinse additive, and a method as set forth in the foregoing objects wherein the flocs which are precipitated from the cleaning solution will be characterized by a particle size that is small enough to permit disposal in a municipal sanitary sewer system.

Other and further objects of the invention, together with the features of novelty appurtenant thereto, will appear in the course of the following description.

DESCRIPTION OF THE INVENTION

In broadest form, the invention encompasses an additive for use in an aqueous cleaning solution comprising a combination of a highly water soluble flocculant characterized by the ability to precipitate contaminant particles from the solution and a betaine stabilizer for the flocculant characterized by the ability to maintain the flocculant in solution until the flocculant encounters the contaminant particles. The two components of the additive are preferably present in a ratio of about 1:1 to 1:5 stabilizer:flocculant, although the quantity of stabilizer may range up to fifteen (15) times the quantity of flocculant (15:1, stabilizer:flocculant). The additive may be utilized alone in conjunction with rinse water to help maintain the water clean but will also find wide utilization in conjunction withh detergents to promote the cleaning process while extending the effective life of the cleaning solution. The detergent and other ingredients will normally be present in an amount ranging from 70–99% by weight of the total cleaning product. The range is widely varied depending upon the cleaner being utilized, the object being cleaned and the practical economics of the particular situation. Suffice it to say that an effective quantity of the particular cleaning constituents which are utilized in conjunction with the additive of the present invention will be necessary in each case where the other cleaning constituents are present.

It has been found that the quantity of the additive, according to the present invention, used in the total cleaning product should be a minimum of one percent by weight or the product does not have sufficient stability to give it a practical shelf life.

The various aspects of the present invention are best understood by considering specific embodiments of the additive and detergents which make use of it, including the formulations given in the following examples:

EXAMPLE 1

Cleaning Solution Additive

| INGREDIENT | % BY WEIGHT |
|---|---|
| Dimethylamine-epichlorohydrin-ethylenediamine | 70% |
| Phosphobetaine stabilizer #1525 (see below) | 30% |

The additive of Example 1 includes a polyamine flocculant which is effective to precipitate dirt and other contaminants that are introduced into a cleaning solution containing the flocculant, and to cause the precipitated contaminants to quickly settle to the bottom of the detergent solution. As a result, the contaminants are effectively removed from the solution since their settling to the bottom places them where they will not be picked up by a cleaning tool which is subsequently dipped in the solution.

In order to accomplish precipitation of the contaminant particles, the quantity of additive as set forth in EXAMPLE 1 utilized in the cleaning product should be a minimum of one percent by weight and preferably two to ten percent by weight. Also, very high molecular weight flocculants (greater than 500,000 for amines greater than 1.4 million for polyacrylamide) should be avoided as these flocculants result in floating flocs rather than precipitates. Preferably, the molecular weight of the flocculant, if an amine, should be no greater than 250,000. The preferred molecular weight for polyacrylamide is 1 million.

The polyelectrolyte flocculants that are effective in precipitating contaminants are generally characterized by instability and have not been used in the past in commercially available detergent solutions at quantities which would be high enough to cause precipitates to form. This is because their instability makes their shelf life so short that it has been commercially impractical to use these compounds as flocculating agents in detergents. However, we have found that both the shelf life stability and the precipitative action of polyelectrolyte flocculants can be greatly enhanced by blending them with a suitable betaine stabilizer. The reasons for the additive effects of the two compounds is not fully understood.

Although both polyamine and polyacrylamide compounds can serve as the flocculant, polyamine resin compositions are preferred because they exhibit a high degree of compatibility with virtually all of the detergents that are commercially available. For this reason and also by reason of its effectiveness in precipitating a wide range of contaminant particles from cleaning solutions, a water soluble polyamine is preferred as the flocculant in the detergent additive. The polyamine compounds also exhibit relative stability compared to other polyelectrolytes, and thus the aforementioned stability problem is reduced by the selection of a polyamine. The polyamine should have a molecular weight of at least 100,000, and it is preferred that the molecular weight be about 200,000–250,000.

As an alternative to the polyamine specified in Example 1, the flocculant in the additive can be selected from other polyamine compounds including: diethylenetriamine, triethylenetetramine, dimethylamine-epichlorohydrin-ethylenediamine polymer and tetraethylenepentamine. The higher alkyl homologes and mixtures of two or more of the foregoing polyamines can also be used. Various monoamines can also be employed as the flocculant such as: di-n-propylamine, dimethylamine, diethylamine, triethylamine and tri-n-propylamine. As indicated above, polyacrylamide, preferably with a molecular weight of 500,000 to 1.4 million can also be employed as the flocculant.

All of the flocculants specified above are capable of precipitating dirt and other contaminants from rinse water or compatible detergent solutions, and all can be made to exhibit adequate stability when blended with a suitable stabilizing agent. The concentrated flocculant solution utilized should be characterized by high water solubility (30–40% by weight in aqueous solution), the ability to precipitate contaminant particles from the solution and preferably to form flocs which will pass a fifty mesh screen (A.S.T.M. Standard). This will assure that the flocs which are precipitated are small enough that they may be disposed of in most municipal sanitary sewer systems.

As previously indicated, the flocculants utilized in the invention lack stability and require stabilization in order to provide a commercially practical detergent or wash additive. It is important that the stabilizer be compatible with the flocculant, that is not interfere with the flocculating ability and preferably that it enhances the cleaning action of the detergent but at the very least that it does not in any way interfere with this cleaning action. Betaine compounds are particularly suited to function as stabilizers for the flocculants used at the quantitative levels which have proven effective.

The particular betaines which find utilization in the formula of the present invention are shown and described in U.S. Pat. No. 4,490,536, incorporated herein by reference, and represented by the formula:

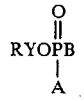

where

A is selected from OH, OM and OYR

B is selected from OH and OM and R is an imidazoline moiety of the formula:

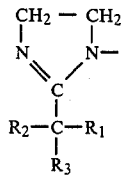

where $R_1$ and $R_2$ are selected from hydrogen, propionic acid, propionitrile, propionamide, or alkylcycloaliphatic or alkali metal or alkaline earth metal salts or amine salts of propionic acid with the proviso that at least one of $R_1$ and $R_2$ must be a propionate derivative, $R_3$ is alkyl, alkenyl, alkoxy, hydroxyalkyl or hydroxalkenyl of from 2 to 20 carbon atoms or aryl or alkylaryl or cycloaliphatic of up to 20 carbon atoms, and Y is alkylene of up to 12 carbon atoms optionally interrupted by up to 3 oxygen atoms, which alkylene chain may be optionally substituted with lower alkyl or alkoxy of not more than 10 carbon atoms; and M is hydrogen, alkali or alkaline earth metals, amines or RY.

A preferred group of betaines, within the general formula give above, which find utilization in the present invention are characterized by the formula

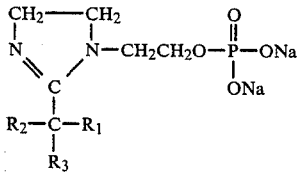

where $R_1$ = H or $CH_2CH_2\overset{O}{\overset{\|}{C}}-ONa$ $R_2$ = $CH_2CH_2\overset{O}{\overset{\|}{C}}-ONa$ $R_3$ = $C_6$-$C_{20}$ alkyl The following examples of betaines within the preferred group are illustrating of those compounds applicable to the present invention:

Betaine Number 1525 (preferred embodiment-Example 1 additive)

$R_1$ = H $R_2$ = $CH_2CH_2\overset{O}{\overset{\|}{C}}-ONa$ $R_3$ = $C_6$ alkyl Betaine Number 1175

-continued $R_1, R_2$ = $CH_2CH_2\overset{O}{\overset{\|}{C}}-ONa$ $R_3$ = $C_{16}$ alkyl Betaine Number 1548

$R_1, R_2$ = $CH_2CH_2\overset{O}{\overset{\|}{C}}-ONa$ $R_3$ = $C_6$, $C_7$ or $C_8$ alkyl Betaine Number 1333

$R_1$ = H $R_2$ = $CH_2CH_2\overset{O}{\overset{\|}{C}}-ONa$ $R_3$ = $C_{10}$ alkyl Betaine Number 1331

$R_1, R_2$ = $CH_2CH_2\overset{O}{\overset{\|}{C}}-ONa$ $R_3$ = $C_{10}$ alkyl

These compounds are also stable in both acidic and alkaline solutions and in high electrolyte concentrations. They are compatible with anionic, cationic, nonionic and amphoteric surfactants. For these reasons, the betaines utilized are highly effective as stabilizers and have been found to actually enhance the cleaning action of the detergent and surfactant.

The composition of the additive comprising flocculant and stabilizer can vary within a range that encompasses approximately 86% flocculant and 14% stabilizer by weight to 7% flocculant and 93% stabilizer by weight, depending upon the flocculant and stabilizer that are used. As indicated by Example 1, a ratio of slightly more than two to one (70% flocculant and 30% stabilizer by weight) is ordinarily appropriate.

While various other components can be utilized in making a cleaning solution according to the present invention, when an aqueous solution of additive or additive plus cleaning agent is employed the total quantity of Na and K ions, from inorganic salts, in the final solution should be no more than 5% by weight. The reason for this is that these ions interfere with the stable system presented by the flocculant and betaine stabilizer.

As will be set forth in more detail hereinafter, the additive is added to various detergents and enhances the detergents in many respects, primarily in that dirt and other contaminant particles which are introduced into a solution of the detergent are quickly precipitated from the solution in order to maintain the solution clear and avoid redeposition of the contaminants on the mop, sponge, rag, brush or other applicator tool which dipped in the detergent solution and used to clean a floor or other surface. The term "cleaning agent" is intended to encompass detergent solutions which include biocides, germicides, surfactants and other traditional components of cleaning compositions. In the case of cleaning that is done by dipping or immersion, the additive of the invention will serve to keep the cleaning solution relatively clean from contaminants that interfere with the cleaning ability of the detergent by precipitating these contaminants to the bottom of the solution.

In each of the following examples, the term "additive" refers to the additive prepared according to the present invention, such as the additive specified in Example 1.

EXAMPLE 2

All Purpose Cleaner

| INGREDIENT | % BY WEIGHT PREFERRED | % BY WEIGHT PERMISSIBLE RANGE |
|---|---|---|
| Water | 76.9 | 1–98 |
| Potassium hydroxide | 0.9 | 0–5 |
| Ethylenediamine-tetraacetic acid | .2 | 0–2 |
| Trisodium phosphate | 1.5 | 0–5 |
| Sodium tripolyphosphate | 1.5 | 0–5 |
| Nonionic alkylated surfactant | 1.0 | 0.5–5 |
| 1-H—imidazole-1-propanoic acid, 2-heptyl-2,3-dihydro-3-(2-hydroxyethyl)-monosodium salt[1] | 5 | 0.5–50 |
| Additive | 7 | 1–30 |

In the general purpose detergent of Example 2, the potassium hydroxide serves as an alkaline builder, as a buffer to neutralize acidic soil, as an enhancer of the interfacial activity of the detergent formulation, and as a saponification agent for fatty soil. The potassium hydroxide can be replaced by another inorganic base such as sodium hydroxide or by an organic base such as triethanolamine, monoethanolamine or isopropanolamine. The ethylenediaminetetraacidic acid is a chelating agent and a sequestrant which prevents minerals in the water supply from settling out of the solution by forming water soluble salts of the minerals. Other chelating agents can be used as a replacement. The trisodium phosphate and sodium tripolyphosphate are alkaline builders employed as cleaning agents to neutralize acidic soils present on the surface which is being cleaned. Alternative alkaline builders include potassium hydroxide, sodium hydroxide, tetrasodium pyrophosphate and tetrapotassium pyrophosphate. The nonionic alkylated surfactant is a general purpose surfactant which functions as a wetting agent, detergent, dispersant and emulsifier. Nonylphenoxypoly(ethyleneoxy)ethanol with 8–18 carbon atoms or more present on the chain is preferred, and other suitable alternatives are polyethylene glycol of secondary alcohol with 3–15 ethylene oxide adduct and octylphenoxypolyethoxyethanol with 8–18 carbon atoms or more present on the chain. The caprylamphopropionate is a detergent, wetting agent, dispersant, emulsifier and surfactant. Suitable alternatives are alkyl imidazoline amphoteric, cocoamidopropylbetaine, sodium salt of 2-caprylic-1(ethyl betaoxipropoic)acid, imidazoline, alkylamide phosphobetaine and other surfactants.

EXAMPLE 3

Solvent Type All Purpose Cleaner

| INGREDIENT | % BY WEIGHT PREFERRED | % BY WEIGHT PERMISSIBLE RANGE |
|---|---|---|
| Water | 82 | 1–99 |
| Tetrapotassium pyrophosphate | 2 | 0–5 |
| Sodium metasilicate pentahydrate | 3 | 0–5 |

-continued

| INGREDIENT | % BY WEIGHT PREFERRED | % BY WEIGHT PERMISSIBLE RANGE |
|---|---|---|
| Nonionic alkylated surfactant | 1 | .5–5 |
| Ethylene glycol monobutyl ether | 5 | 0–15 |
| Additive | 7 | 1–30 |

The tetrapotassium pyrophosphate and sodium metasilicate pentahydrate are alkaline builders which neutralize acid soils, and the sodium metasilicate pentahydrate additionally functions as a thickener, corrosion inhibitor and protective agent for metal, ceramic, china and glass surfaces. The ethylene glycol monobutyl ether is a solvent and degreaser which also acts as a cleaner, soil penetrant and coalescent. Other solvents that can be used include ethylene glycol monoethyl ether, ethylene glycol dibutyl ether and monomethyl ether.

EXAMPLE 4

Powdered Car Wash Detergent

| INGREDIENT | % BY WEIGHT PREFERRED | % BY WEIGHT PERMISSIBLE RANGE |
|---|---|---|
| Tetra sodium pyrophosphate | 15 | 0–99 |
| Sodium tripoly-phosphate | 10 | 0–99 |
| Sodium carbonate | 40 | 0–99 |
| Sodium sulfate | 29 | 0–75 |
| Nonionic alkylated surfactant | 1 | 0.5–5 |
| Additive | 5 | 1–5 |

The sodium carbonate is an alkaline builder which serves as a water softener and acid neutralizer. The sodium sulfate acts as a buffer, filler and thickening agent. Other salts such as sodium carbonate and sodium chloride can be used instead.

EXAMPLE 5

Heavy Duty Powdered Car Wash Compound

| INGREDIENT | % BY WEIGHT PREFERRED | % BY WEIGHT PERMISSIBLE RANGE |
|---|---|---|
| Sodium tripoly-phosphate | 51 | 0–99 |
| Sodium metasilicate pentahydrate | 41 | 0–99 |
| Nonionic alkylated surfactant | 3 | 0.5–5 |
| Additive | 5 | 1–5 |

EXAMPLE 6

Liquid Car Wash Compound

| INGREDIENT | % BY WEIGHT PREFERRED | % BY WEIGHT PERMISSIBLE RANGE |
|---|---|---|
| Water | 76 | 1–99 |
| Caprylampho-propionate | 5 | 0.5–50 |
| Nonionic alkylated | 1 | 0.5–5 |

-continued

| INGREDIENT | % BY WEIGHT PREFERRED | % BY WEIGHT PERMISSIBLE RANGE |
|---|---|---|
| surfactant | | |
| Ethylene glycol monobutyl ether | 3 | 0–15 |
| Additive | 15 | 1–30 |

EXAMPLE 7

Heavy Duty Cleaner

| INGREDIENT | % BY WEIGHT PREFERRED | % BY WEIGHT PERMISSIBLE RANGE |
|---|---|---|
| Water | 82.3 | 1–98.5 |
| Sodium metasilicate pentahydrate | 4 | 0–5 |
| Sodium tripoly-phosphate | 1 | 0–5 |
| Ethylenediamine-tetraacetic acid | 1 | 0–2 |
| Nonionic alkylated Surfactant | 1.7 | 0.5–5 |
| Additive | 10 | 1–20 |

EXAMPLE 8

Disinfectant Cleaner

| INGREDIENT | % BY WEIGHT PREFERRED | % BY WEIGHT PERMISSIBLE RANGE |
|---|---|---|
| Water | 68.8 | 1–98.4 |
| Nonionic alkylated surfactant | 1.0 | 0.5–5 |
| Ethylenediamine-tetraacetic Acid | 0.2 | 0–2 |
| Antimicrobial Agent | 9 | 0.1–10 |
| Caprylampho-propionate | 11 | 0.5–50 |
| Tetrapotassium pyrophosphate | 1 | 0–5 |
| Sodium tripoly-phosphate | 2 | 0–5 |
| Additive | 7 | 1–30 |

The antimicrobial agent also acts as a germicide, disinfectant and sanitizing agent. Preferably, N-alkyl (60%$C_{14}$, 30%$C_{16}$, 5%$C_{12}$, 5%$C_{18}$) dimethyl benzyl ammonium chloride in N-alkyl (68%$C_{12}$, 32%$C_{14}$) dimethyl ethylbenzyl ammonium chloride are used, although the following are also suitable: O-phenylphenol; 2,4,5-trichlorophenol; sodium o-phenol; phenol tetrahydrite; benzylkonium chloride; dithiocarbonates; calcium propionate; and other available antimicrobial agents.

EXAMPLE 9

Car Wash Solution

| INGREDIENT | % BY WEIGHT PREFERRED | % BY WEIGHT PERMISSIBLE RANGE |
|---|---|---|
| Water | 70 | 1–98 |
| KOH | 2 | 0–5 |
| Tetrapotassium pyrophosphate | 1.5 | 0–5 |
| Trisodium phosphate | 1.5 | 0–5 |
| Nonionic alkylated surfactant | 1 | 0.5–5 |

-continued

| INGREDIENT | % BY WEIGHT PREFERRED | % BY WEIGHT PERMISSIBLE RANGE |
|---|---|---|
| Caprylampho-propionate | 11 | 0.5–50 |
| Ethylene glycol monobutyl ether | 6 | 0–15 |
| Additive | 7 | 1–30 |

EXAMPLE 10

Hand Dish Washing Solution

| INGREDIENT | % BY WEIGHT PREFERRED | % BY WEIGHT PERMISSIBLE RANGE |
|---|---|---|
| Water | 77 | 1–98.5 |
| Alkanolamine salt of linear sulfonic acid | 3 | 0–5 |
| Sodium salt of fatty acid | 2 | 0–5 |
| Caprylampho-propionate | 11 | 0.5–50 |
| Additive | 7 | 1–30 |

EXAMPLE 11

Cleaner for Automatic Scrubbing Machines

| INGREDIENT | % BY WEIGHT PREFERRED | % BY WEIGHT PERMISSIBLE RANGE |
|---|---|---|
| Water | 72 | 1–98.5 |
| Sodium salt of linear sulfonic acid | 2 | 0–5 |
| Ethylenediamine-tetraacetic acid | 0.2 | 0–5 |
| Sodium metasilicate pentahydrate | 2.8 | 0–5 |
| Capyrlampho-propionate | 11 | 0.5–50 |
| Ethylene glycol monobutyl ether | 5 | 0–15 |
| Additive | 7 | 1–30 |

EXAMPLE 12

Heavy Duty Cleaner

| INGREDIENT | % BY WEIGHT PREFERRED | % BY WEIGHT PERMISSIBLE RANGE |
|---|---|---|
| Water | 76.3 | 1–98 |
| Potassium hydroxide 45% | 2 | 0–5 |
| Sodium tripolyphos-phate | 1.5 | 0–5 |
| Ethylenediamine-tetraacetic acid | 0.2 | 0–2 |
| Nonionic alkylated surfactant | 2 | 0.5–50 |
| Caprylampho-propionate | 11 | 0.5–50 |
| Additive | 7 | 1–30 |

EXAMPLE 13

Metal Cleaning Compound

| INGREDIENT | % BY WEIGHT PREFERRED | % BY WEIGHT PERMISSIBLE RANGE |
|---|---|---|
| Water | 72.8 | 1–98 |
| Caprylampho-propionate | 11 | 0.5–5 |
| Ethylenediamine-tetraacetic acid | 0.2 | 0–2 |
| Nonionic alkylated surfactant | 3 | 0.5–5 |
| KOH (45% soln.) | 2 | 0–5 |
| Sodium metasilicate pentahydrate | 4 | 0–5 |
| Additive | 7 | 1–30 |

EXAMPLE 14

Wax Stripper

| INGREDIENT | % BY WEIGHT PREFERRED | % BY WEIGHT PERMISSIBLE RANGE |
|---|---|---|
| Water | 71.8 | 1–99 |
| Sodium metasilicate pentahydrate | 4 | 0–5 |
| Ethylenediamine-tetraacetic acid | 0.2 | 0–5 |
| Alkyl hydroxide | 1.0 | 0–5 |
| Caprylampho-propionate | 11 | 0.5–50 |
| Ethylene glycol monobutyl ether | 5 | 0–15 |
| Additive | 7 | 1–30 |

The alkyl hydroxide is preferably of the type commercially available under the trademark AMMONIUM AQUA 26, and suitable replacements are sodium hydroxide, potassium hydroxide, triethanolamine, monoethanolamine, and isopropanolamine. The ethylene glycol monobutyl ether is a solvent, carrier, penetrant, and cleaner which reduces surface tension. Alternative solvents are other suitable glycol ethers.

EXAMPLE 15

Whitewall Tire Cleaner Solution

| INGREDIENT | % BY WEIGHT PREFERRED | % BY WEIGHT PERMISSIBLE RANGE |
|---|---|---|
| Water | 71.8 | 1–98.5 |
| Sodium metasilicate pentahydrate | 4 | 0–5 |
| Ethylenediamine-tetraacetic Acid | 0.2 | 0–5 |
| Potassium hydroxide (45%) | 2 | 0–5 |
| Ethylene glycol monobutyl ether | 4 | 0–2 |
| Caprylampho-propionate | 11 | 0.5–50 |
| Additive | 7 | 1–30 |

EXAMPLE 16

Powdered Whitewall Cleaner

| INGREDIENT | % BY WEIGHT PREFERRED | % BY WEIGHT PERMISSIBLE RANGE |
|---|---|---|
| Sodium tripoly-phosphate | 16 | 0–99 |
| Sodium metasilicate pentahydrate | 23 | 0–99 |
| Trisodium phosphate | 20 | 0–75 |
| Nonionic alkylated surfactant | 1 | 0.5–5 |
| Sodium sulfate | 33 | 0–70 |
| Additive | 7 | 1–5 |

EXAMPLE 17

Rinse Additive

| INGREDIENT | % BY WEIGHT PREFERRED | % BY WEIGHT PERMISSIBLE RANGE |
|---|---|---|
| Water | 92.8 | 80–99 |
| Ethylenediamine-tetraacetic acid | 0.2 | 0–5 |
| Additive | 5 | 1–10 |
| Isopropylalcohol | 2.0 | 0–5 |

EXAMPLE 18

Heavy Duty Liquid Laundry Detergent concentrate

| INGREDIENT | % BY WEIGHT PREFERRED | % BY WEIGHT PERMISSIBLE RANGE |
|---|---|---|
| Water | 76.8 | 1–98 |
| Linear Alkyl Naphthalene Sulfonate Detergent | 3 | 0.5–5 |
| Caprylampho-propionate | 11 | 0.5–50 |
| Sodium Linear Alkyl Sulfonate | 2 | 0–5 |
| Ethylenediamine-tetraacetic acid | .2 | 0–5 |
| Additive | 7 | 1–30 |

In Example 18 above, the linear alkyl sulfonate could be replaced by sodium linear alkyl sulfonate potassium linear alkyl sulfonate, sodium salt of dodecylbenzene sulfonic acid, sodium tripolyphosphate, or potassium tripolyphosphate.

Also in Example 18, the sodium linear alkyl sulfonate could be replaced by potassium linear alkyl sulfonate, sulfonated alkyl ester, magnesium lauryl sulfonate or modified ammonium alkyl sulfonate.

EXAMPLE 19

Powdered Laundry Heavy Duty Detergent Concentrate

| INGREDIENT | % BY WEIGHT PREFERRED | % BY WEIGHT PERMISSIBLE RANGE |
|---|---|---|
| Sodium tripoly-phosphate | 32 | 1–95 |
| Sodium carbonate | 26 | 1–75 |
| Sodium sulfate | 21 | 1–75 |

-continued

| INGREDIENT | % BY WEIGHT PREFERRED | % BY WEIGHT PERMISSIBLE RANGE |
|---|---|---|
| Nonionic alkylated surfactant | 1 | 0–5 |
| Sodium metasilicate pentahydrate | 15 | 0–99 |
| Additive | 5 | 1–5 |

In Example 19 above sodium tripolyphosphate may be replaced with sodium hydroxide, potassium hydroxide or tetra sodium pyrophosphate. Also in this example, sodium sulfate can be used as a substrate for the sodium carbonate. Sodium sulfate may be replaced by sodium carbonate. Finally, in Example 19, the nonionic alkylated surfactant may be replaced with polyethylene glycol of secondary alcohols with 3–15 ethylene oxide adduct or with octylphenoxypolyethoxyethanol with 8–18 carbon atoms present in the chain.

EXAMPLE 20

Carpet Shampoo

| INGREDIENT | % BY WEIGHT PREFERRED | % BY WEIGHT PERMISSIBLE RANGE |
|---|---|---|
| Sodium lauryl sulfate and amine oxide | 5 | 1–5 |
| Caprylamphopropionate | 11 | 0.5–5 |
| water | 77 | 1–98 |
| additive | 7 | 1–30 |

It is contemplated that one of the principal uses of the detergent additive of the present invention will be in general janitorial cleaning of floors and other large surfaces. Although automated equipment is sometimes used for the cleaning of floors, and the compositions of the present invention may be utilized in such equipment, manual floor mopping remains prevalent. Typically, a detergent is added to wash water in a mop bucket, and a mop is alternately dipped into the wash water and applied to the floor. Each time the mop is dipped in the mop bucket, the dirt and other contaminants it has picked up are added to the wash water, and the water quickly becomes dirty. The dirt in the water is picked up by the mop head and redeposited on the floor. As a consequence, considerable amounts of dirt remain on the floor even after it has been thoroughly mopped.

Similar problems are encountered in various other cleaning operations, such as when a rag, sponge, brush or other applicator is repeatedly dipped in a pan, bucket or other container which holds a cleaning solution and is then applied to a surface which is being cleaned. For example, washing automobiles and other vehicles with a sponge and bucket results in the water in the bucket becoming contaminated with dirt which is redeposited on the vehicle each time the sponge is dipped in the bucket. The use of a scrub brush to clean surfaces is subject to the same problem.

In accordance with the present invention, this problem is virtually eliminated and the effective life of the cleaning and rinsing solutions is extended because dirt and other contaminants which are introduced into the cleaning solution quickly precipitate and settle on the bottom of the container where they are not picked up when the mop or other applicator is subsequently dipped in the cleaning solution. By way of example, mopping of a floor can be carried out effectively by first adding to a mop bucket or other container a detergent solution which includes an aqueous solution of an effective quantity of a suitable detergent and at least 1% by weight of the additive of the present invention. The detergent can be added in powder form to water in the mop bucket, or it can be added in the form of liquid concentrate or fully diluted detergent solution. The additive can be introduced into the detergent solution in the form of liquid or powder added to the solution in the mop bucket, or the additive can already be present in the detergent at the time it is introduced into the bucket. The cleaning solutions and compounds specified in the examples as well as variations thereof readily apparent to those skilled in the art can be used.

In any case, the aqueous solution in the mop bucket is a homogeneous solution of a suitable detergent, the flocculant contained in the additive, and the stabilizer which acts to maintain the flocculant in solution and also to enhance its ability to precipitate contaminants which are introduced into the solution. The floor is mopped in the usual way by repeatedly dipping the mop head in the bucket to pick up the detergent solution, using the mop head to mop the floor, and dipping the mop head back in the bucket to remove dirt and other contaminants that are picked up from the floor. Ordinarily, the mop head is subjected to squeezing or wringing to remove excess solution.

The dirt particles and other contaminants which are picked up on the mop and transferred into the mop bucket are precipitated from the solution by the flocculant, and the precipitated particles are heavier than the solution such that they quickly settle on the bottom of the mop bucket. Normally, the settled particles occupy no more than about the bottom 5% of the bucket, so the top 95% of the solution remains clear and substantially free of contamination. Consequently, the mop can be dipped in the solution repeatedly and will not pick up contaminants so long as the mop is not dipped so deeply that it approaches the bottom of the bucket.

In this manner, cleaning of floors and other surfaces can be carried out without picking up and redepositing contaminants that have previously been removed. It is important to recognize that the detergent additive of the present invention is present from the outset before any contaminants are introduced into the wash water or other solution, rather than being added to a previously contaminated solution in order to clarify and remove contaminants that are already present in relatively large amounts. It is also important to recognize that the detergent additive permits the thorough and efficient cleaning of virtually any surface, large or small, with a suitable applicator such as a mop, brush, rag, sponge or other tool. Cleaning solutions having a wide variety of compositions and components, such as those specified in the example, can be used with the detergent additive, and its compatibility with a wide variety of different detergents gives it considerable versatility and permits its use in a wide variety of cleaning operations.

It will also be appreciated that the invention of the present invention encompasses a method of cleaning whereby objects are dipped or immersed into a container of an aqueous cleaning solution which includes the highly water soluble flocculant characterized by the ability to precipitate contaminant particles that are removed from the object and a stabilizer effective to maintain the flocculant in solution until it reacts with the contaminant particles. The object is dipped into the container; removed; and a second object is then dipped into the same aqueous cleaning solution and removed. The effective life of the cleaning solution which is used for the dipping or immersing process is extended substantially because of the additive of the present invention which makes the method a much more effective cleaning technique than has heretofore been possible. As with other embodiments of the invention discussed above, this method may be employed with a rinse solution or more typically in combination with a detergent which is present in the cleaning solution. The various examples heretofore given as formulations with which the invention can be utilized are applicable to the method of dipping and immersion just described.

From the foregoing examples, it will be apparent that the present invention also contemplates a cleaning solution comprising a cleaning agent and the additive according to the present invention in aqueous solution or the cleaning agent and additive of the invention in powder form, for preparation of an aqueous solution. By "cleaning agent" is meant a typical detergent and detergent additives such as water softeners, biocides, germicides, surfactants, colorants, perfumes, corrosion inhibitors, wetting agents, foaming agents, thickening agents, antifoaming agents, surface tension reducing agents, penetrants, buffers, fillers, and the like. Illustrations of typical additives are given in the foregoing examples.

A general formula for both dry and aqueous general cleaning products according to the invention are given below.

| % by weight | |
|---|---|
| Dry Formula Cleaner | |
| 1–5 | Additive |
| 95–99 | Cleaning Agent |
| Liquid Formula Cleaner | |
| 1–30 | Additive |
| 0.5–55 | Cleaning Agent |
| 15–98 | Water |

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

We claim:

1. An additive for use in an aqueous cleaning solution at a level of 1–30% by weight of the total solution, said additive comprising:

a water soluble polyamine or polyacrylamide polyelectrolyte flocculant characterized by the ability to precipitate contaminant particles present in said solution; and a water soluble phosphobetaine of the formula

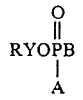

wherein

A is selected from OH, OM and OYR

B is selected from OH and OM

R is an imidazoline reactant moiety of the formula

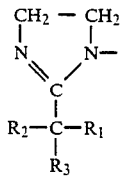

where $R_1$ and $R_2$ are selected from hydrogen, propionic acid, propionitrile, propionamide, propionate esters of $C_1$–$C_{12}$ alkyls, alkylaryl or alkylcycloaliphatic, or alkali metal or alkaline earth metal salts or amine salts of propionic acid with the proviso that at least one of $R_1$ and $R_2$ is a propionate derivative;

$R_3$ is alkyl, alkenyl, alkoxy, hydroxyalkyl or hydroxyalkenyl of from 2 to 20 carbon atoms each or aryl or alkylaryl or cycloaliphatic of up to 20 carbon atoms, Y is alkylene of up to 12 carbon atoms optionally interrupted by up to 3 oxygen atoms, which alkylene may be optionally substituted with lower alkyl or alkoxy of not more than 10 carbon atoms, and M is selected from alkali metals, alkaline earth metals and amines, said flocculant and said phosphobetaine being present in a ratio of from 1:1 to 1:15 flocculant:phosphobetaine; and said flocculant and stabilizer being present in a ratio from 1:5 to 15:1, stabilizer:flocculant.

2. An additive as set forth in claim 1, wherein said flocculant and said betaine stabilizer are present in a ratio of from about 1:5 to 1:1, stabilizer:flocculant.

3. An additive as set forth in claim 1, wherein said flocculant is characterized by the ability to make flocs which will pass a 50 mesh screen.

4. An additive as set forth in claim 3, wherein when said flocculant is a polyamine it has a molecular weight of approximately 250,000 or less.

5. A method of preparing a cleaning solution to be utilized in cleaning a surface with an applicator tool, said method comprising:

providing a quantity of water in a container;

adding a water soluble detergent to said container;

adding 1–30% by weight of an additive according to claim 1 to said water solution, whereby contaminant particles introduced into said solution by said applicator tool precipitate in the container thereby maintaining the liquid substantially free of contaminants above the level of the precipitated contaminant particles.

6. The method as set forth in claim 5, wherein said adding step comprises adding an additive according to claim 2.

7. A method as set forth in claim 6, wherein said adding step comprises adding an additive according to claim 4.

8. A method as set forth in claim 7, wherein said detergent is present in a quantity of ½ to 55% by weight of said cleaning solution.

9. A method of preparing a cleaning solution to be utilized in cleaning a surface with an applicator tool, said method comprising providing a quantity of water in a container;

adding a water soluble detergent to said container;

combining with said water solution 1-30% by weight of an additive comprising a water soluble polyacrylamide having a molecular weight of 1.4 million or less or a polyamine polyelectrolyte flocculant having a molecular weight of 250,000 or less and characterized by the ability to precipitate particles from solution and a betaine of the formula:

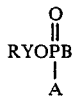

wherein

A is selected from OH, OM and OYR

B is selected from OH and OM

R is an imidazoline reactant moiety of the formula

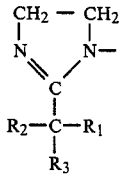

where $R_1$ and $R_2$ are selected from hydrogen, propionic acid, propionitrile, propionamide, propionate esters of $C_1$-$C_{12}$ alkyls, alkylaryl or alkylcycloaliphatic, or alkali metal or alkaline earth metal salts or amine salts of propionic acid with the proviso that at least one of $R_1$ and $R_2$ is a propionate derivative;

$R_3$ is alkyl, alkenyl, alkoxy, hydroxyalkyl or hydroxyalkenyl of from 2 to 20 carbon atoms each or aryl or alkylaryl or cycloaliphatic of up to 20 carbon atoms, Y is alkylene of up to 12 carbon atoms optionally interrupted by up to 3 oxygen atoms, which alkylene may be optionally substituted with lower alkyl or alkoxy of not more than 10 carbon atoms, and M is selected from alkali metals, alkaline earth metals and amines.

10. A method of cleaning a surface comprising:

applying to the surface of an aqueous solution comprising 1-30% by weight of an additive according to claim 1, and removing said aqueous solution from said surface and placing said removed solution into a container where flocs will form and precipitate contaminant particles from said solution.

11. A method as set forth in claim 10, wherein is included the additional step of repeating said applying step by utilizing said solution from said container, followed by repeating said removing step.

12. A method as set forth in claim 11, wherein said applying step includes utilizing a squeezable applicator and including the additional steps of wringing out said applicator to return said removed solution from said surface to said container and repeating said applying step by utilizing said soluton from said container, followed by repeating said removing step.

13. A method as set forth in claim 10, wherein said applying step comprises applying an additive according to claim 2.

14. A method as set forth in claim 10, wherein said applying step comprises applying an additive according to claim 4.

15. A method as set forth in claim 10, wherein said applying step comprises applying an additive according to claim 5.

16. A method as set forth in claim 10, wherein said applying step comprises applying an additive according to claim 6.

17. A method as set forth in claim 10, wherein said applying step comprises applying an additive according to claim 7.

18. A cleaning solution comprising 15-98% by weight water;

1-30% by weight of an additive comprising a water soluble polyamine or polyacrylamide polyelectrolyte flocculant characterized by the ability to precipitate contaminant particles introduced into said solution; and a water soluble phosphobetaine of the formula

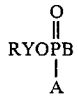

wherein

A is selected from OH, OM and OYR

B is selected from OH and OM

R is an imidazoline reactant moiety of the formula

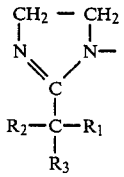

where $R_1$ and $R_2$ are selected from hydrogen, propionic acid, propionitrile, propionamide propionate esters of $C_1$-$C_{12}$ alkyls, alkylaryl or alkylcycloaliphatic, or alkali metal or alkaline earth metal salts or amine salts of propionic acid with the proviso that at least one of $R_1$ and $R_2$ is a propionate derivative;

$R_3$ is alkyl, alkenyl, alkoxy, hydroxyalkyl or hydroxyalkenyl of from 2 to 20 carbon atoms each or aryl or alkylaryl or cycloaliphatic of up to 20 carbon atoms, Y is alkylene of up to 12 carbon atoms optionally interrupted by up to 3 oxygen atoms, which alkylene may be optionally substituted with lower alkyl or alkoxy of not more than 10 carbon atoms, and M is selected from alkali metals, alkaline earth metals and amines, said flocculant and said phosphobetaine being present in a ratio of from 1:1 to 1:15 flocculant:phosphobetaine, said flocculant and stabilizer being present in a ratio of 1:5 to 15:1, stabilizer:flocculant; and 0.5–55% by weight of a detergent.

19. A solution as set forth in claim 18, wherein said flocculant and said betaine stabilizer are present in a ratio of from 1:5 to 1:1, stabilizer:flocculant.

20. A solution as set forth in claim 18, wherein said additive is characterized by the ability to make flocs which will pass a 50 mesh screen.

21. A solution as set forth in claim 20, wherein when said flocculant is a polyamine it has a molecular weight of approximately 250,000 or less.

22. A cleaning solution as set forth in claim 18, wherein the total quantity of sodium and potassium ions in the solution from inorganic salts is no greater than about 5% by weight.

23. A powdered, water soluble cleaning composition comprising:

1–5% by weight of an additive as set forth in claim 1; and

95–99% by weight of a detergent.

24. A cleaning composition as set forth in claim 23, wherein said additive comprises an additive as set forth in claim 2.

25. A cleaning composition as set forth in claim 23, wherein said additive comprises an additive as set forth in claim 3.

26. A cleaning composition as set forth in claim 23, wherein said additive comprises an additive as set forth in claim 4.

27. A cleaning composition as set forth in claim 23, wherein said additive comprises an additive as set forth in claim 5.

28. A cleaning composition as set forth in claim 23, wherein said additive comprises an additive as set forth in claim 6.

29. An additive as set forth in claim 3, wherein when said flocculant is polyacrylamide it has a molecular weight of approximately 1.4 million or less.

30. A method as set forth in claim 6, wherein said adding step comprises adding an additive according to claim 29.

31. A solution as set forth in claim 20, wherein when said flocculant is polyamine it has a molecular weight of 250,000 or less.

* * * * *

UNITED STATES PATENT AND TRADEMARK OFFICE

CERTIFICATE OF CORRECTION

PATENT NO. : 4,820,450

DATED : April 11, 1989

INVENTOR(S) : Raymond G. Wile, et al.

It is certified that error appears in the above-identified patent and that said Letters Patent is hereby corrected as shown below:

Column 16, lines 42-44, delete in its entirety the sentence beginning "said flocculant" and ending "flocculant: phosphobetaine; and".

Same column, line 45, delete "stabilizer" and substitute "phosphobetaine".

Same column, line 46, delete "stabilizer" and substitute "phosphobetaine".

Column 19, lines 11-13, delete in its entirety the sentence beginning "said flocculant" and ending "flocculant: phosphobetaine,".

Same column, line 14, delete "stabilizer" and substitute "phosphobetaine".

Same column, line 15, delete "stabilizer" and substitute "phosphobetaine".

Signed and Sealed this

Ninth Day of October, 1990

*Attest:*

HARRY F. MANBECK, JR.

*Attesting Officer*

*Commissioner of Patents and Trademarks*